US007011464B2

(12) United States Patent
Sekino

(10) Patent No.: US 7,011,464 B2
(45) Date of Patent: Mar. 14, 2006

(54) APPARATUS FOR DETECTING AN END PORTION OF A RECORDING MEDIUM

(75) Inventor: Toshiharu Sekino, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 396 days.

(21) Appl. No.: 10/384,056

(22) Filed: Mar. 6, 2003

(65) Prior Publication Data

US 2004/0173764 A1 Sep. 9, 2004

(51) Int. Cl.
*B41J 2/36* (2006.01)

(52) U.S. Cl. ..... 400/613; 400/611; 226/45; 242/357; 242/475.5; 242/563

(58) Field of Classification Search ..... 400/586, 400/587, 590, 591, 593, 594, 601, 602, 603, 400/621, 625, 629, 646, 611, 613; 902/18, 902/19, 30, 22, 23, 26, 27, 31, 32, 33; 235/379; 271/198, 259; 226/45; 242/357, 475.5, 242/563

See application file for complete search history.

(56) References Cited

U.S. PATENT DOCUMENTS 4,971,468 A * 11/1990 Yokoi ..... 400/634
5,018,718 A * 5/1991 Matsuno et al. ..... 271/245

(Continued)

FOREIGN PATENT DOCUMENTS

JP 05-338335 12/1993
JP 10-218450 8/1998

(Continued)

OTHER PUBLICATIONS

U.S. Appl. No. 10/382,124, filed Mar. 5, 2003; inventor: Toshiharu Sekino; Title: "Printer".

*Primary Examiner*—Andrew H. Hirshfeld
*Assistant Examiner*—Kevin D. Williams
(74) *Attorney, Agent, or Firm*—Frishauf, Holtz, Goodman & Chick, P.C.

(57) ABSTRACT

A printer having a hopper without shaft which performs a print operation on a roll of continuous paper. Detection marks are provided in flanges provided in supported members removably attached to the continuous paper, and the presence/absence of the detection mark in a detection position of an optical sensor is determined. A rear end of the continuous paper in the hopper is determined if the result of determination of the presence/absence of the detection mark during conveyance of the continuous paper is the same. A passage length from the position of the determined rear end of the continuous paper to a print unit is equal to or longer than a predetermined maximum print size. By this arrangement, the rear end of the continuous paper can be detected without upsizing the apparatus and without complicating the structure, and the continuous paper can be effectively utilized without causing shortage of the continuous paper during execution of print operation.

6 Claims, 7 Drawing Sheets

U.S. PATENT DOCUMENTS 5,467,182 A * 11/1995 Hower et al. ..... 399/364
5,898,155 A * 4/1999 Imai et al. ..... 235/379
5,911,527 A * 6/1999 Aruga et al. ..... 400/149
6,045,211 A * 4/2000 Tokuda ..... 347/33
6,318,917 B1 * 11/2001 Taylor ..... 400/613
6,367,731 B1 * 4/2002 Takizawa et al. ..... 242/417.3
6,639,688 B1 * 10/2003 Imai ..... 358/1.14
2003/0103228 A1 * 6/2003 Imai ..... 358/1.14
2003/0146943 A1 * 8/2003 Lehmkuhl et al. ..... 346/24
2005/0195226 A1 * 9/2005 Takeishi et al. ..... 347/8
2005/0200875 A1 * 9/2005 Sugimoto et al. ..... 358/1.13

FOREIGN PATENT DOCUMENTS

JP 2000-143054 A 5/2000

* cited by examiner

APPARATUS FOR DETECTING AN END PORTION OF A RECORDING MEDIUM

BACKGROUND OF THE INVENTION

1. Field of the Invention

The present invention relates to an apparatus for detecting an end portion of a recording medium for applying to a printer which prints a predetermined subject on a roll of continuous paper, and more particularly, to an apparatus for detecting an end portion of a recording medium for applying to a printer which performs a print operation with a predetermined maximum print size.

2. Description of Related Art

Printers which print a predetermined subject on a roll of continuous paper then cut the continuous paper in a position corresponding to a print size are known.

The above printers include a printer having a hopper to accommodate the continuous paper. As the form of accommodation of continuous paper in the hopper, the printers are briefly classified into printer having a hopper with a support shaft to support the center of the continuous paper and a printer having a hopper without such support shaft.

For example, for a print operation with a predetermined print size of e.g. securities or ATM statement information, various printers capable of detecting a remaining amount of unprinted continuous paper lest the continuous paper become short during print operation are known.

In a case where a remaining amount of continuous paper is detected in a printer having a hopper without support shaft, there is a printer applied an apparatus for detecting an end portion of a recording medium for detecting a rear end of the continuous paper on a guide passage from the hopper to a print unit, or there is a printer applied an apparatus for detecting an end portion of a recording medium for detecting a near end of the continuous paper in correspondence with an outer diameter.

However, to prevent shortage of continuous paper during a print operation by using the former apparatus for detecting an end portion of a recording medium, as it is necessary to ensure a passage length equal to or longer than a predetermined maximum print size as a length from a rear-end detection position to the print unit on the guide passage, the printer increases in size.

Further, in a case where the latter apparatus for detecting an end portion of a recording medium is used, as only the near end of the continuous paper is detected, the continuous paper cannot be effectively used to the rear end, thus the continuous paper is wasted by the unprinted and discarded amount.

In some of the printers having a hopper with support shaft, an encoder to the support shaft, and the remaining amount of continuous paper is detected by detecting rotation of the encoder in accordance with rotation of the support shaft. Since the encoder is attached to the support shaft and a mechanism to detect the rotation of the encoder is provided, the structure of the printer is complicated.

Further, in some printers, a roller for rotation detection is provided in contact with an outer peripheral surface of the continuous paper, and an encoder is attached to the roller, such that the remaining amount of the continuous paper is detected by detecting rotation of the encoder in accordance with rotation of the roller. However, as in the case of the above-described art, since the encoder is attached to the roller and a mechanism to detect the rotation of the encoder is provided, the structure of the printer is complicated.

SUMMARY 0F THE INVENTION

Accordingly, an object of the present invention is, in a printer having a hopper without shaft, to detect a rear end of continuous paper without upsizing the apparatus and without complicating the structure, and to effectively utilize the continuous paper without causing shortage of the continuous paper during execution of print operation.

Another object of the present invention is to more reliably prevent the occurrence of shortage of continuous paper during execution of print operation.

Further, another object of the present invention is to accurately determine detection of rear end of continuous paper during execution of print operation.

These objects of the present invention are attained by a novel printer of the present invention.

Therefore, according to the novel printer applied an apparatus for detecting an end portion of a recording medium of the present invention, a detection mark is provided on a flange provided in a supported member removably attached to a roll of continuous paper, the presence/absence of detection mark in a detection position of an optical sensor is determined, a rear end of the continuous paper in a hopper is determined if the result of determination of presence/absence of the detection mark during conveyance of the continuous paper is the same, and the length of a passage from the determined rear end position of the continuous paper to a print unit is equal to or longer than a predetermined maximum print size.

BRIEF DESCRIPTION OF THE DRAWINGS

Deeper understanding of the present invention and other advantages of the present invention will be easily obtained from the following description taken in conjunction with the accompanying drawings.

DETAILED DESCRIPTION OF THE PREFERRED EMBODIMENT

An embodiment of the present invention will be described in accordance with FIGS. 1 to 7. In the present embodiment, an application to a printer which performs a print operation with a predetermined maximum print size on a roll of continuous paper is shown.

Figure 1:
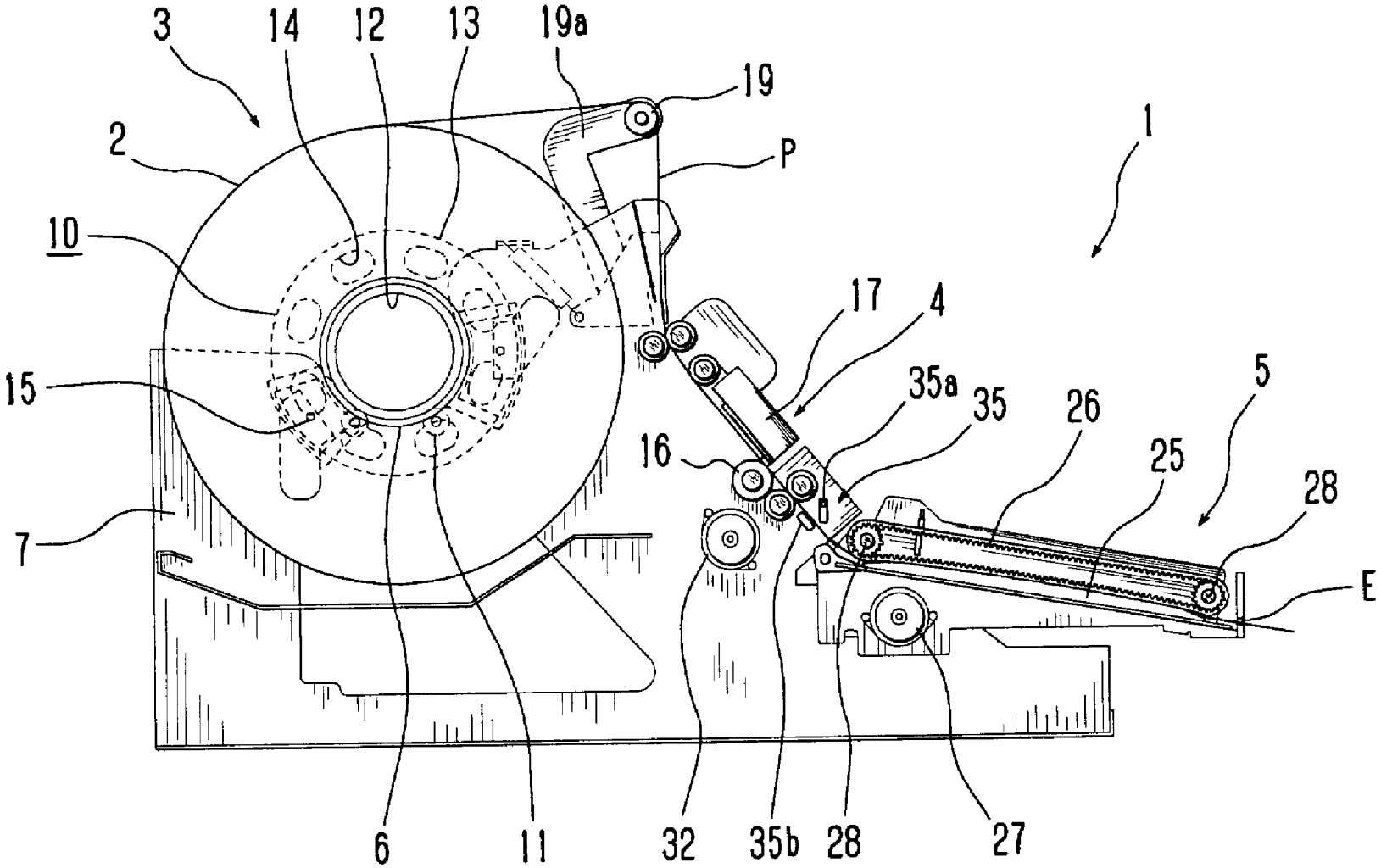
FIG. 1 is a cross-sectional side view of a printer applied an apparatus for detecting an end portion of a recording medium of the present invention.
Figure 2:
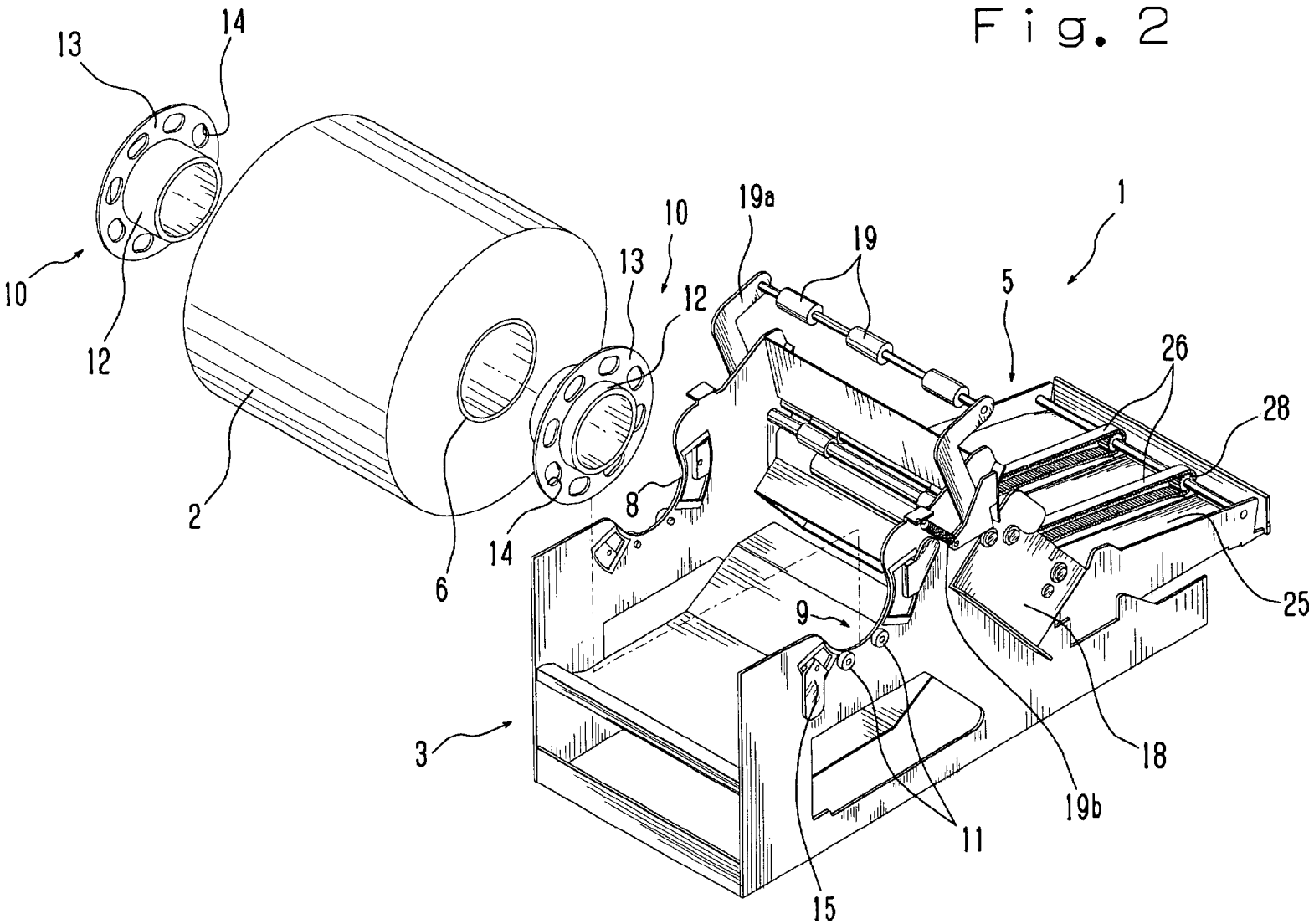
FIG. 2 is a perspective view showing a status where the printer applied an apparatus for detecting an end portion of a recording medium of the present invention is partially-exploded and viewed from the rear surface side.

FIG. 1 is a cross-sectional side view of a printer applied an apparatus for detecting an end portion of a recording medium of the present invention; and FIG. 2, a rear perspective view showing a status where the printer applied an apparatus for detecting an end portion of a recording medium of the present invention is partially exploded. A printer 1 has a hopper 3 accommodating a roll of continuous paper 2, a print unit 4 which performs printing on the continuous paper 2, and a transport unit 5 which conveys the continuous paper 2.

The hopper 3, the print unit 4 and the transport 5 are communicated with each other via a guide passage P. The guide passage P connecting the hopper 3 to an emitting port E via the print unit 4 and the transport unit 5, guides the continuous paper 2 pulled out from the hopper 3 to the emitting port E via the print unit 4 and the transport unit 5. Hereinafter, in the guide passage P, the side of the hopper 3 is referred to as an upstream side, the side of the emitting port E, a downstream side.

A tension roller 19 which holds the continuous paper 2 pulled out from the hopper 3 and conveyed to the print unit 4 under tension is provided in the guide passage P. The tension roller 19 is rotatably supported with an arm 19*a* provided on a side plate 7. The arm 19*a* is pressed with a spring 19*b* in a direction to hold the continuous paper 2 under tension.

A paper end sensor 34 (See FIG. 5), from which an output varies in correspondence with the presence/absence of the continuous paper 2 in the guide passage P, is provided in the guide passage P. As the paper end sensor 34, for example, an optical sensor or the like of reflective type or transmission type can be employed. In the present embodiment, a transmission type optical sensor, which becomes ON if the continuous paper 2 is absent in the guide passage P, is used as the paper end sensor 34.

Next, the hopper 3 will be described. The hopper 3 has a holding structure to hold the continuous paper 2 pullably from the other end side (an end on the outer peripheral side) in a lengthwise direction. As the continuous paper 2 which can be held in the holding structure, paper having a roll shaft 6 to rotate the continuous paper 2, with an end on the roll-start side of the continuous paper 2 fixed to the roll shaft 6 by pasting or the like, and paper with the end on the roll-start side not fixed to the roll shaft 6 are available. In the present embodiment, the continuous paper 2 with its end not fixed to the roll shaft 6 as in the case of the latter paper is employed.

Note that the continuous paper 2 is not limited to the continuous paper 2 with its end not fixed to the roll shaft 6, but the end of the continuous paper 2 is fixed so as to be removed from the roll shaft 6 when pulled by a predetermined force.

In the present embodiment, the roll shaft 6 around which the continuous paper 2 is rolled has a cylindrical shape, however, the shape of the roll shaft 6 is not limited to the cylindrical shape but may be, e.g., a polygonal shape. In use of any shape, the continuous paper 2 has the roll shaft 6 to which cores 10 to be described later are attached at both ends.

The holding structure has bearings 9 having disc-shaped notches 8 respectively formed in a pair of side plates 7, and the cores 10 which are removably attached to the both ends of the roll shaft 6 in an axial direction and which is rotatably supported with the bearings 9.

The bearing 9 has plural rollers 11, which are provided on the side plates 7 with their outer peripheral surfaces face the notches 8 and which are rotatable about an axis parallel to the axial direction of the roll shaft 6 of the continuous paper 2. The rollers 11 are respectively provided inside and outside the opposed side plates 7 for the respective notches 8.

The core 10 has a cylindrically-shaped supported member 12 with one end side inserted in the roll shaft 6 upon attachment to the continuous paper 2 and the other end side removably supported by the bearing 9, and a disc-shaped flange 13 provided in a central portion in a lengthwise direction of the supported member 12.

The outer diameter of the supported member 12 is set to be approximately equal to the inner diameter of the roll shaft 6 such that, upon print processing to be described later, when the continuous paper 2 is pulled out from the hopper 3, idle rotation does not occur between the supported member 12 and the roll shaft 6. Note that the supported member 12 is not limited to the cylindrically-shaped member but may be, e.g., a columnar-shaped member. The shape of the supported member 12 on the outer peripheral side depends on the shape of the roll shaft 6 on the inner peripheral side. The support member has a size such that the member can be fitted into the inner periphery of the roll shaft 6 and can rotate the core 10 in accordance with rotation of the roll shaft 6.

The outer diameter of the flange 13 is set to be greater than the outer diameter of the supported member 12. By this arrangement, when the supported member 12 is inserted into the roll shaft 6, the flange 13 serves as a stopper, and the core 10 stops at the flange 13. Holes 14 as plural detection marks, provided concentrically with the flange 13 and through the axial direction of the supported member 12, are formed in the flange 13.

The holding structure supports the supported member 12 inserted into the roll shaft 6 of the continuous paper 2 from the lower side by the bearings 9, and enables rotation of the supported member 12 in the bearings 9, upon print processing to be described later, in accordance with the rotation of the roll shaft 6 by which the continuous paper 2 is pulled out. When the supported member 12 rotates, the flange 13 provided on the supported member 12 also rotates. Here, the mechanism that supports a pair of supported members 12, having flanges 13 removably attached to centers of both ends of the continuous paper 2 and opposed to both end surfaces of the continuous paper 2, rotatably and removably in the hopper 3, is realized with the bearing 9 and the cores 10.

Further, the hopper 3 has a rotation detection sensor 15 as an optical sensor having a detection position on a rotational orbit of the holes 14 which rotate by the rotation of the flange 13. The rotation detection sensor 15 of the present embodiment, having an unshown light emitting device which emits light onto the rotational orbit of the hole 14 and an unshown photoreception device which is provided on the same side as that of the light emitting device with respect to the flange and which receives the light emitted from the light emitting device, is a reflective type photo sensor from which an output varies in correspondence with the amount of received light at the photoreception device. The position of light irradiation from the light emitting device becomes the detection position.

The amount of light emitted from the light emitting device and received by the photoreception device differs with material to reflect light emitted from the light emitting device. That is, since the material of a plate surface portion of the flange 13 to reflect light is different from that of the hole 14, the amount of reflected light from the plate surface portion of the flange 13 is different from that from the hole 14, and the amount of received light at the photoreception device from the plate surface portion of the flange 13 is different from that from the hole 14.

As the detection mark, for example, a material having a reflectivity different from that of the plate surface portion of the flange 13 may be provided as well as the hole 14. The material having the different reflectivity may be made by painting ink or the like or by attaching a seal.

In the present embodiment, as the holes 14 are provided as the detection marks, if the remaining amount of the continuous paper 2 is large and the outer diameter of the continuous paper 2 is on the outer peripheral side from the position of the hole 14 (the detection position by the rotation detection sensor 15), the light emitted from the light emitting device is reflected from side surface portions of the continuous paper 2, however, if the remaining amount of the continuous paper is small and the outer diameter of the continuous paper 2 is on the inner peripheral side from the position of the hole 14, the light is not reflected and passes through the hole 14. Accordingly, the output value from the rotation detection sensor 15 when the light emitting device has emitted light to the hole 14 differs with the remaining amount of the continuous paper 2. If the outer diameter of the continuous paper 2 is on the outer peripheral side from the position of the hole 14, the rotation detection sensor 15 shows a high output value, however, if the outer diameter of the continuous paper 2 is on the inner peripheral side from the position of the hole 14, the rotation detection sensor 15 does not receive the reflected light and shows a low output value.

Note that the rotation detection sensor 15 is not limited to the reflective type photo sensor. For example, a transmission type photo sensor having a light emitting device to emit light and a photoreception device, provided in a position opposed to the light emitting device with the flange therebetween, to receive the light emitted from the light emitting device, from which an output varies in correspondence with the amount of received light at the photoreception device.

Next, the print unit 4 will be described. The print unit 4 has a platen 16 having a roller structure, and a printhead 17 provided opposite approachably/departably to the platen 16 via the guide passage P.

The platen 16 is supported rotatably about an axis between head support plates 18 provided on the side plates 7. The platen 16, rotate-driven by a feed motor 32, also performs a function of conveying the continuous paper 2 in a predetermined direction.

The printhead 17 is supported swingably in a direction departing from the platen 16 between the head support plates 18. Although illustration and explanation of the printhead will be omitted since it is a well-known technique, the printhead 17 of the present embodiment is a thermal head having plural heat-generating resistors arrayed in lines. Upon the print processing to be described later, the plural heat-generating resistors are driven-controlled so as to selectively generate heat by 1 line in correspondence with print data, thus a predetermined subject is printed on the continuous paper 2.

The platen 16 also performs a function of conveying, together with the transport unit 5, the continuous paper 2 in the guide passage P from the upstream side to the downstream side.

Next, the transport unit 5 will be described. The transport unit 5 is provided on the downstream side from the print unit 4 in a direction of guiding the continuous paper 2 in the guide passage P. The transport unit 5 has a lower-side guide member 25 which supports the continuous paper 2 conveyed in the guide passage P from a lower side, and an endless-type conveyance belt 26 provided in contact with the lower-side guide member 25 from an upper position. The conveyance belt 26 is put around a pair of gears 28, provided as a pair on the upstream side and the downstream side of the guide passage P and at least one of which is rotate-driven by a feed motor 27. The conveyance belt also performs a function of pressing the continuous paper 2 at the transport unit 5 against the lower-side guide member 25. Here the mechanism that guide-conveys the roll of continuous paper 2 accommodated in a hopper 3 along a guide passage P, is realized with the platen 17 and the transport unit 5 realize.

Upon the print processing to be described later, the feed motors 27 and 32 are driven such that the continuous paper 2 passes through the print unit 20 by a minimum print length L in the guide passage P. Note that the minimum print length L means a length the same as or equivalent to a minimum print unit as a length printable by the printhead 17 at once. By this arrangement, upon the print processing to be described later, the platen 16 and the conveyance belt 26 pull the continuous paper 2 by a length the same as or equivalent to a length printable by the printhead 17 at once.

As the cores 10 are rotatably supported by the bearings 9, when the continuous paper 2 is pulled out by the platen 16 and the conveyance belt 26, the cores 10 rotate in accordance with the rotation of the roll shaft 6 in correspondence with the pulling. Note that if the same length continuous paper 2 is pulled out, the rotation angle of the core 10 becomes smaller as the outer diameter of the continuous paper 2 is greater.

In the present embodiment, in a case where the feed motors 27 and 32 are driven and the continuous paper 2 in a status where it has a maximum diameter (use initial status) is pulled out by the minimum print length L, the holes 14 and the plate portion of the flange 13 are formed at an intervals such that they arrive at the detection position by the rotation detection sensor 15 at least at once. That is, in the flange 13, the holes 14 are formed such that, in a case where the roll shaft 6 rotates in accordance with the pulling of the continuous paper 2 having the maximum diameter by the minimum print length L and the cores 10 rotate in correspondence with the rotation of the roll shaft 6, at least one of the hole 14 and the plate portion of the flange 13 passes the detection position by the rotation detection sensor 15 and stops the position of the flange 13 or the hole 14.

Figure 3:
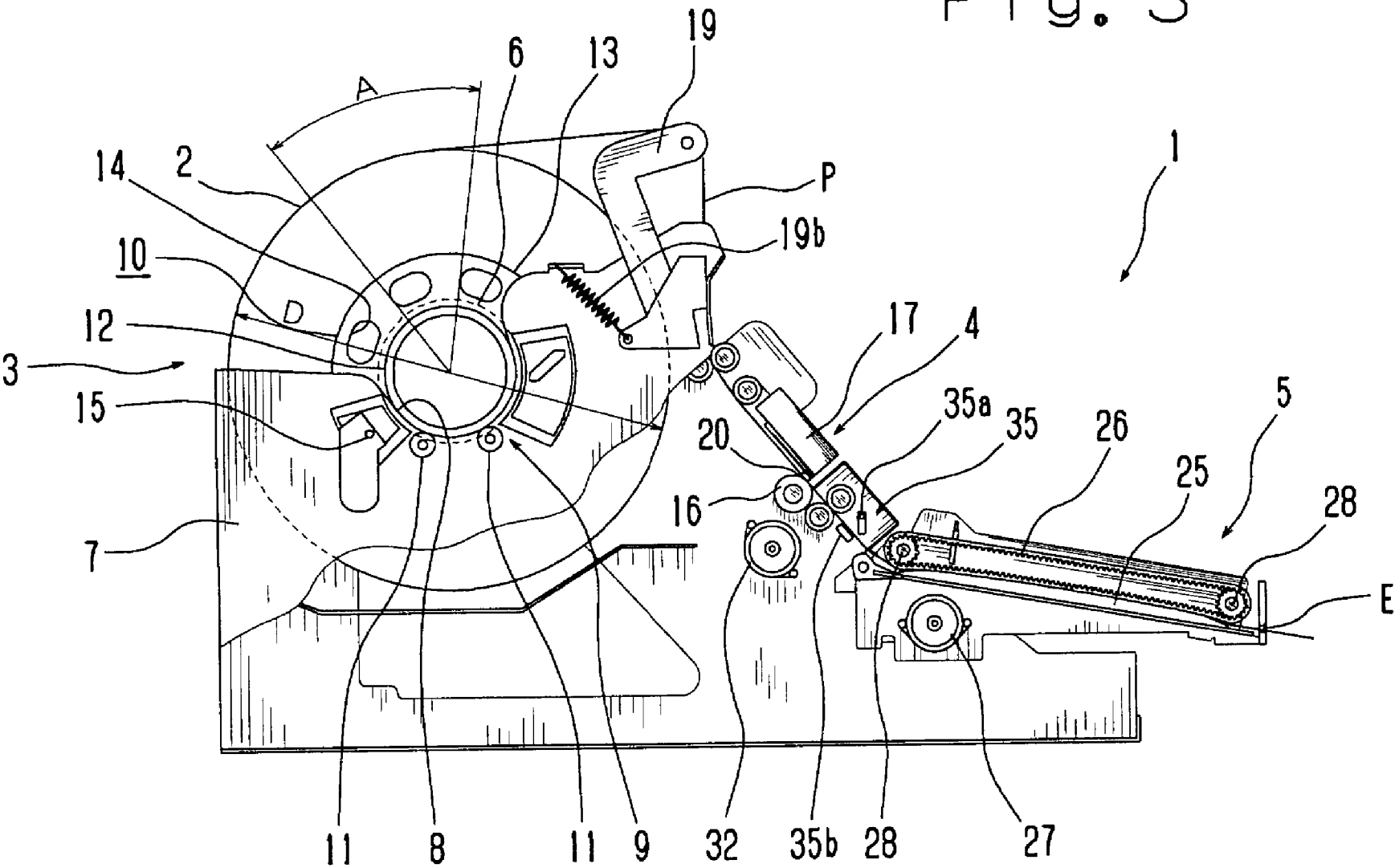
FIG. 3 is a cross-sectional side view explaining a guide passage length between a hopper and a print unit in the printer applied an apparatus for detecting an end portion of a recording medium of the present invention.

In the present embodiment, as shown in FIG. 3, assuming that the outer diameter of the continuous paper 2 in the use initial status is D, the arrangement angle A of the hole is set so as to satisfy the angle represented in the following expression (1).

$$A \leqq 360 \times L/(\pi \times D) \quad (1)$$

Further, as an end of the continuous paper 2 on the roll start side is not fixed to the roll shaft 6, upon the print operation to be described later, when the continuous paper 2 is pulled out to the roll start side by the platen 16 and the conveyance belt 26, the end of the continuous paper 2 on the roll start side is removed from the roll shaft 6. Hereinafter, the end of the continuous paper 2 on the roll start side is referred to as a rear end of the continuous paper 2. When the rear end of the continuous paper 2 is removed from the roll shaft 6, the rotation of the roll shaft 6 stops, and the rotation of the flange 13 also stops.

Figure 4:
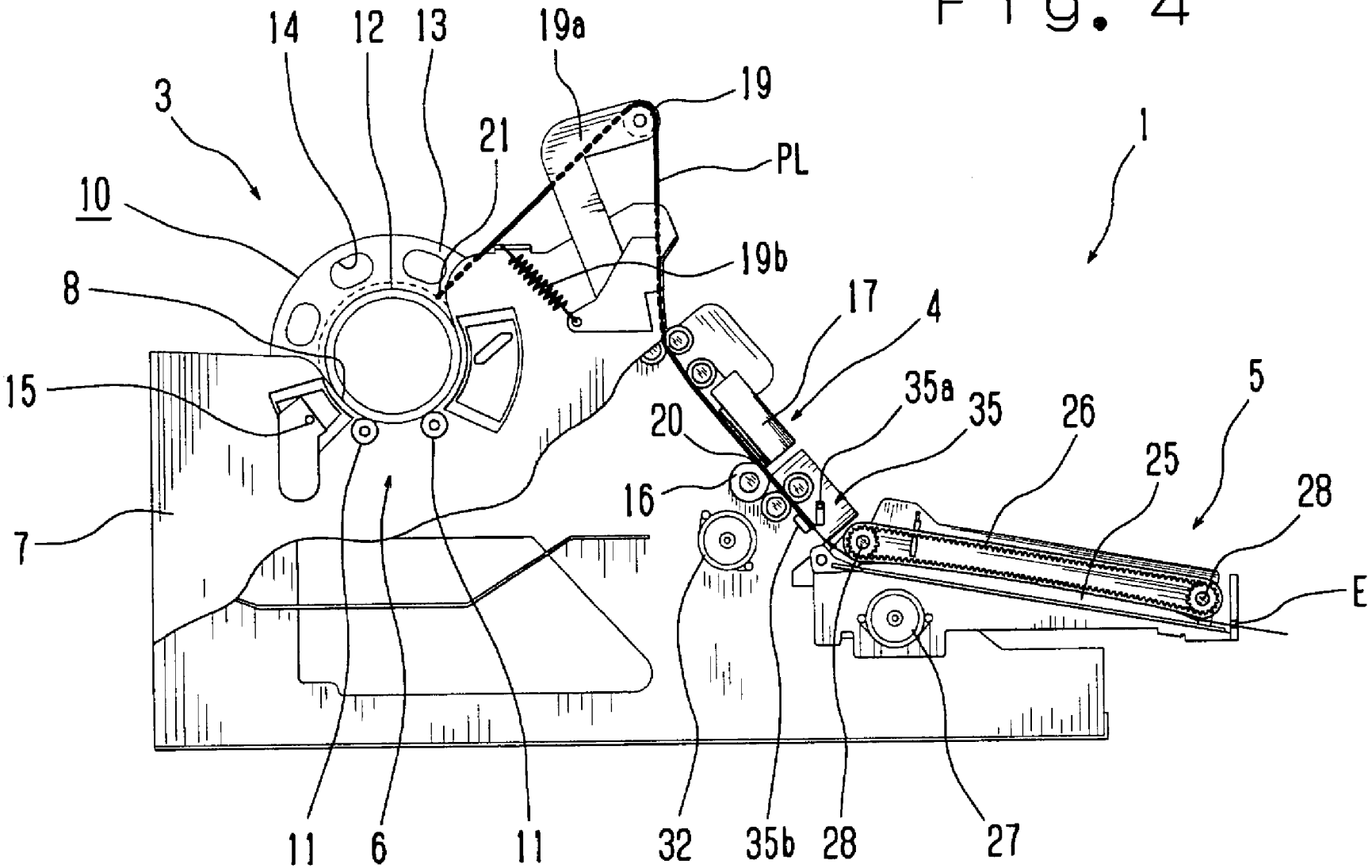
FIG. 4 is an explanatory view explaining an arrangement angle of a hole in a flange in the printer applied an apparatus for detecting an end portion of a recording medium of the present invention.

As shown in FIG. 4, assuming that the position at the instant when the continuous paper 2 is pulled out to the rear end and the rear end of the continuous paper 2 is removed from the roll shaft 6 is an end position 21, and the position where the platen 16 and the printhead 17 are in contact with each other is a print position 20, in the printer 1 of the present embodiment, in the above-described guide passage P, a passage length PL (a bold line in FIG. 4) from the end position 21 to the print position 20 is set to be equal to or longer than a maximum print size to be described later.

In addition, a cutter unit 35 to cut the continuous paper 2 is provided on the guide passage P. Although illustration and explanation of the cutter unit will be omitted since it is a well-known technique, cutter units having various mechanisms, such as a cutter unit having a guillotine structure which moves a movable blade on the paper surface in upward/downward directions in FIG. 1 thereby cuts the continuous paper 2, a cutter unit having a structure, using a combination of fixed blade 35*a* having a flat-and long plate shape and a movable blade 35*b* slided by a motor or the like to the fixed blade 35*a* as shown in the figure, which cuts the continuous paper by sliding the movable blade 35*b* to the fixed blade 35*a*, and a cutter unit having a structure which cuts the continuous paper by moving a disc-shaped rotary blade, can be employed as the cutter unit 35. Any cutter unit 35 is driven by a driving force transmitted from a driving source such as a cutter motor 33 (See FIG. 5).

Figure 5:
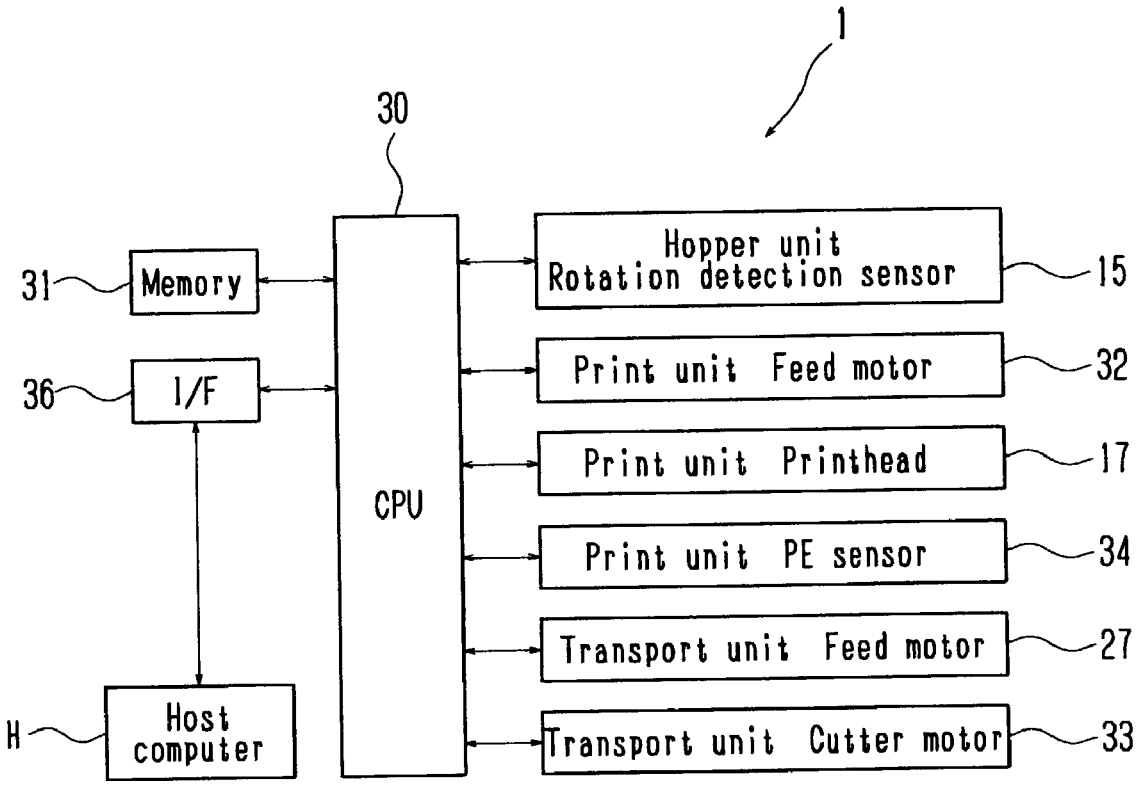
FIG. 5 is a block diagram showing electrical connection among respective elements included in the printer applied an apparatus for detecting an end portion of a recording medium of the present invention.

Next, the electrical connection among respective elements included in the printer 1 of the present invention will be described. FIG. 5 is a block diagram showing the electrical connection among respective elements included in the printer 1 applied an apparatus for detecting an end portion of the continuous paper 2. The printer 1 has a CPU 30 which drive-controls the respective elements in the printer 1. A ROM in which fixed data such as a control program is previously stored and a memory 31 constructed with a RAM or the like which rewritably holds variable data and which functions as a work area for the CPU 30, are connected to the CPU 30.

Although not particularly shown, a reception buffer in which print data is temporarily stored, an editing buffer in which the print data stored in the reception buffer is mapped, a character generator buffer which is referred to upon mapping of print data and in which letter characters indicating letters to be printed are stored in correspondence with character codes, and the like, are ensured in the memory 31.

Although not particularly shown, a determination value table for storing the difference value between the output value from the rotation detection sensor 15 when the light emitted from the light emitting device is reflected from the plate surface portion of the flange 13, and the output value from the rotation detection sensor 15 when the light emitted from the light emitting device is irradiated to the hole 14 and passed therethrough, as a prescribed variation amount, is ensured in the memory 31.

Further, similarly, not particularly shown, a final determination flag area, which is referred to upon the print processing to be described later and in which a flag is set in correspondence with the presence/absence of unprinted print data, is ensured in the memory 31. In the present embodiment, upon print operation based on some print data, if next print data does not exist and if the rear end of the continuous paper 2 has been detected in the print processing to be described later, the flag is set in the final determination area.

The above-described printhead 17, the feed motors 27 and 32, the cutter motor 33 and the paper end sensor 34 are connected to the CPU 30 respectively via an unshown control circuit.

The printhead 17, the feed motors 27 and 32 and the cutter motor 33 are driven-controlled by respectively corresponding control circuits based on drive signals outputted from the CPU 30. The printhead 17, driven-controlled by the corresponding control circuit upon the print processing to be described later, selectively drives the heat generating resistors in the printhead 17. The feed motors 27 and 32, driven-controlled by the corresponding control circuits upon the print processing to be described later, transmit a driving force to the gear 28 and the platen 16 to pull the continuous paper 2 by the minimum print length from the hopper 3 and convey the paper. Similarly, the cutter motor 33, driven-controlled by the corresponding control circuit upon the print processing to be described later, transmits a driving force to the cutter unit 35 to cut the continuous paper 2 in a predetermined position.

In the present embodiment, a series of operations of performing printing based on print data by the print unit 4 and cutting the continuous paper 2 in the predetermined position by the cutter unit 35 by drive-controlling the print unit 4 and the cutter unit 35 by the CPU 30 and the control circuits, will be referred to as a print operation.

In the print operation, for example, print data with a predetermined print size based on a prescribed format such as securities and ATM statement information is handled. As the prescribed format printable by the printer 1, plural sizes are set, however, the maximum print size is previously determined. In the present embodiment, the length of the continuous paper 2 in the conveyance direction determined by a format in which the length in the conveyance direction after printing is the maximum is the maximum print size.

Note that the type of format for print operation is selectively determined in correspondence with print data transmitted from the host computer H to be described later.

The CPU 30 determines the presence/absence of continuous paper in the guide passage P based on an output value from the paper end sensor 34. In the present embodiment, if the paper end sensor is in an ON status, it is determined that the continuous paper does not exist in the guide passage.

Further, upon the print processing to be described later, the CPU 30 determines the remaining amount and presence/absence of the continuous paper 2 in the hopper 3 based on the variation amount in the output values from the rotation detection sensor 15 during driving of the feed motors 27 and 32.

In addition, an I/F 36 which performs communication with the host computer H is connected to the CPU 30. Upon the print processing to be described later, print data transmitted from the host computer H is received via the I/F 36, and is stored into the printer buffer of the memory. Further, information indicating e.g. the status on the printer side such as the occurrence of error is transmitted to the host computer H via the I/F 36.

Figure 6:
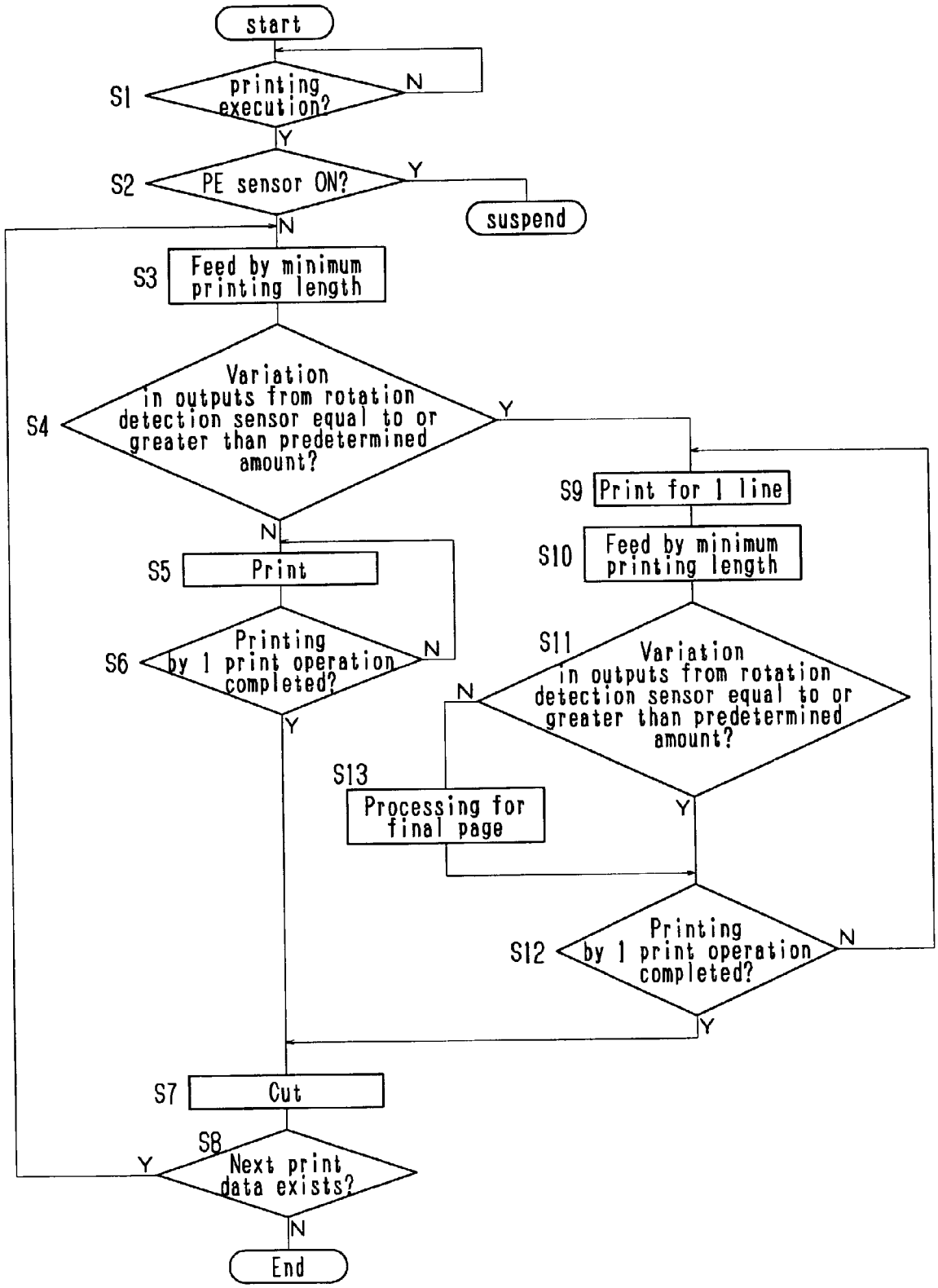
FIG. 6 is a flowchart schematically explaining print processing performed by a CPU based on a control program stored in a memory in the printer applied an apparatus for detecting an end portion of a recording medium of the present invention.

Next, the print processing performed by the CPU 30 based on the control program stored in the memory 31 will be described with reference to FIGS. 6 and 7. FIG. 6 is a flowchart schematically explaining the print processing performed by the CPU 30 based on the control program stored in the memory 31.

In the print processing, first, the process is on standby until it is determined by receiving a print command transmitted from the host computer H that print execution has been instructed (N at step S1), and if it is determined that the print execution has been instructed (Y at step S1), it is determined based on the output value from the paper end sensor 34 whether or not the paper end sensor 34 is ON (step S2).

If it is determined that the paper end sensor 34 is ON based on the output value from the paper end sensor 34 (Y at step S2), it is determined that the paper end has come and the print processing is suspended. At this time, it may be arranged such that the host computer H is informed of the paper end.

If it is determined that the paper end sensor 34 is not ON (N at step S2) based on the output value from the paper end sensor 34, the feed motors 27 and 32 are forward-driven and the continuous paper 2 is conveyed by the minimum print length L (step S3).

It is determined, based on the output values from the rotation detection sensor 15 before and after the conveyance of the continuous paper 2 by the minimum print length L by forward driving the feed motors 27 and 32, whether or not the variation amount between the output value from the rotation detection sensor 15 before conveyance of the continuous paper 2 by the minimum print length L and the output value from the rotation detection sensor 15 after the conveyance of the continuous paper 2 by the minimum print length L is equal to or greater than the previously-determined prescribed variation amount (step S4).

If the remaining amount of the continuous paper 2 is large and the outer diameter of the continuous paper 2 is on the outer peripheral side from the position of the hole 14, the light emitted from the light emitting device, whether irradiated to the plate surface portion of the flange 13 or irradiated to the hole 14, is reflected, accordingly, the output value is always high (See FIG. 7A) although a slight difference occurs between the plate surface portion of the flange 13 and the hole 14.

On the other hand, if the remaining amount of the continuous paper 2 is small and the outer diameter of the continuous paper 2 is smaller and on the inner peripheral side from the position of the hole 14, the light emitted from the light emitting device, if irradiated to the plate surface portion of the flange 13, is reflected, while if irradiated to the hole 14, is passed therethrough. Accordingly, a difference occurs between the output values (See FIG. 7B) regarding the plate surface portion of the flange 13 and the hole 14.

In the present embodiment, as the angle A formed with the respective holes 14 and the center of the roll shaft is set so as to satisfy the range represented in the expression (1), if the outer diameter of the continuous paper 2 is smaller than the position of the hole 14, the variation amount equal to or greater than the prescribed variation amount can be detected in the output value from the rotation detection sensor 15 by conveying the continuous paper 2 by the minimum print length L.

If it is determined that the variation amount between the output values from the rotation detection sensor 15 before and after the conveyance of the continuous paper 2 by the minimum print length L is less than the prescribed variation amount (N at step S4), the printing is performed (step S5) based on the received print data until it is determined that the printing based on the print data received with the print command has been completed (N at step S6).

If it is determined that the printing based on the received print data has been completed (Y at step S6), the continuous paper 2 is cut by the cutter unit 35 in the predetermined position (step S7). Here the function as means for performing the print operation is realized by the processing from step S5 to step S7.

Then, the final determination flag area is referred to, and the presence/absence of the flag in the final determination flag area is determined, thereby the presence/absence of next print data is determined (step S8).

In the present embodiment, as it is determined that next print data does not exist if a case where the flag is set in the final determination flag area, it is determined at step S8 that next print data does not exist if the flag is set in the final determination flag area.

If it is determined that next print data exists (Y at step S8), the process proceeds to step S3.

If it is determined that the variation amount between the output values from the rotation detection sensor 15 before and after the conveyance of the continuous paper 2 by the minimum print length L is equal to or greater than the prescribed variation amount (Y at step S4), print data of an amount corresponding to the minimum print length L conveyed at step S3, i.e., printing is performed for 1 line of the heat generating resistors (step S9), and the feed motors 27 and 32 are forward-driven to further convey the continuous paper 2 by the minimum print length L (step S10).

Then, based on the variation amount between the output values from the rotation detection sensor before and after the conveyance of the continuous paper 2 by the minimum print length L by forward-driving the feed motors 27 and 32, it is determined whether or not the variation amount between the output value from the rotation detection sensor 15 before conveyance of the continuous paper 2 by the minimum print length L and the output value from the rotation detection sensor 15 after the conveyance of the continuous paper 2 by the minimum print length L is equal to or greater than the previously-determined prescribed variation amount (step S11). Here the function as means for determining the rear end of the continuous paper 2 is realized.

If it is determined that the variation amount between the output values from the rotation detection sensor 15 before and after the conveyance of the continuous paper 2 by the minimum print length L is equal to or greater than the prescribed variation amount (Y at step S11), it is determined whether or not the printing based on the received print data has been completed (step S12). If it is determined that printing based on the received print data has been completed (Y at step S12), the process proceeds to step S7. Here the function as means for performing the print operation is realized by the processing from step S9 to step S12.

If it is determined that the printing based on the received print data has not been completed (N at step S12), the process proceeds to step S9.

Note that in a case where the remaining amount of the continuous paper 2 is small and the outer diameter of the continuous paper 2 is on the inner peripheral side from the position of the hole 14, a difference occurs between the output values regarding the plate surface portion of the flange 13 and the hole 14 since the plate surface portion of the flange 13 and the hole 14 alternately pass the detection position of the rotation detection sensor 15 by the rotation of the flange 13.

In other words, even if the outer diameter of the continuous paper 2 is on the inner peripheral side from the position of the hole 14, the output value is constant if the flange 13 does not rotate.

That is, upon start of print operation, in a case where there is variation in the output values from the rotation detection sensor 15 in accordance with the conveyance of the continuous paper 2 but the variation in the output values from the rotation detection sensor 15 in accordance with the conveyance of the continuous paper 2 during the printing stops, it means that the rear end of the continuous paper 2 is removed from the roll shaft 6.

Figure 7A:
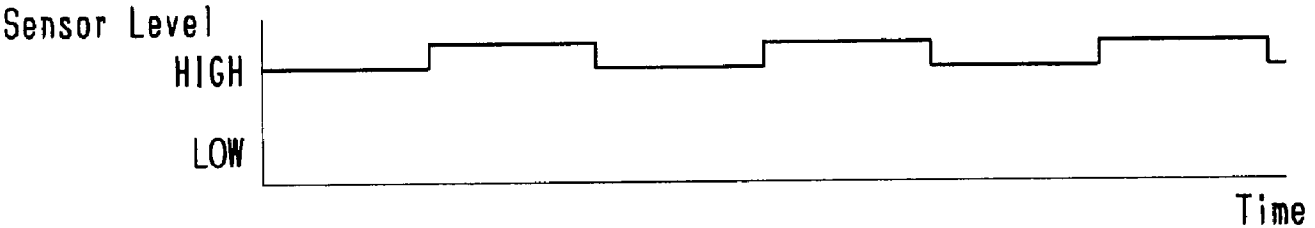
FIG. 7A is a timing chart showing variation of an output value from a rotation detection sensor upon the print processing in the printer applied an apparatus for detecting an end portion of a recording medium of the present invention.
Figure 7B:
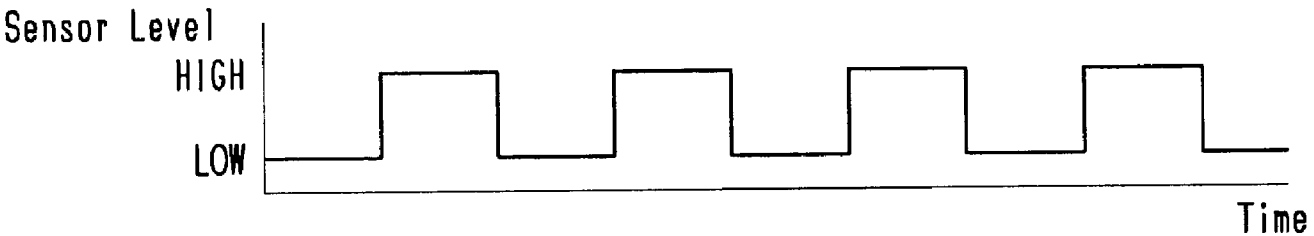
FIG. 7B is a timing chart showing the variation of the output value from the rotation detection sensor upon the print processing in the printer applied an apparatus for detecting an end portion of a recording medium of the present invention.
Figure 7C:
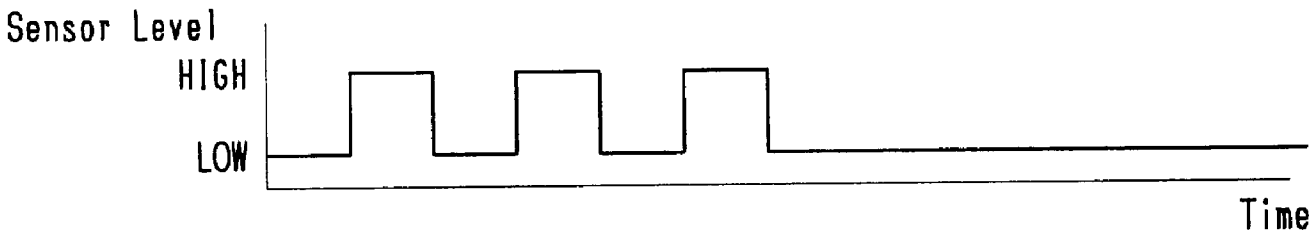
FIG. 7C is a timing chart showing the variation of the output value from the rotation detection sensor upon the print processing in the printer applied an apparatus for detecting an end portion of a recording medium of the present invention.
Figure 7D:
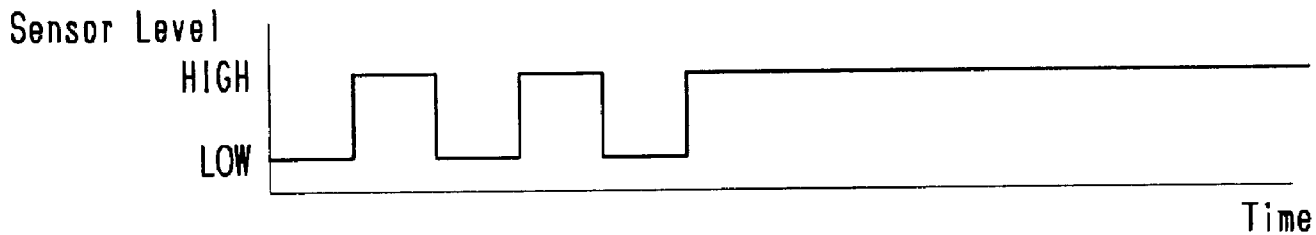
FIG. 7D is a timing chart showing the variation of the output value from the rotation detection sensor upon the print processing in the printer applied an apparatus for detecting an end portion of a recording medium of the present invention.

As shown in FIG. 7C, this situation can be interpreted that the rear end of the continuous paper 2 is removed from the roll shaft 6 in a status where the detection position of the rotation detection sensor 15 is positioned in the hole 14 as shown in FIG. 7C, or that the end of the continuous paper 2 on the roll start side is removed from the roll shaft 6 in a status where the detection position of the rotation detection sensor 15 is positioned in the plate surface portion of the flange 13 as shown in FIG. 7D.

Accordingly, if it is determined that the variation amount between the output values from the rotation detection sensor 15 before and after the conveyance of the continuous paper 2 by the minimum print length L is less than the prescribed variation amount (N at step S11) although it is determined at step S4 that it is determined that the variation amount between the output values from the rotation detection sensor 15 before and after the conveyance of the continuous paper 2 by the minimum print length L is equal to or greater than the prescribed variation amount, the flag is set in the final determination area (step S13), and the process proceeds to step S12. In the present embodiment, a function as means for determining the presence/absence of the detection mark is realized by the processing at step S11.

By this arrangement, as the rear end of the continuous paper 2 can be detected in the hopper 3, even in a case where the detection position for the rear end of the continuous paper 2 is within the hopper 3 and the passage length from the rear end position of the continuous paper 2 to the print unit 4 is ensured as a length equal to or longer than the prescribed maximum print size, the printer 1 is not upsized.

If it is determined at step S12 that the variation amount between the output value from the rotation detection sensor 15 before conveyance of the continuous paper 2 by the minimum print length L and the output value from the rotation detection sensor 15 after the conveyance of the continuous paper 2 by the minimum print length L is less than the previously-determined prescribed variation amount, it is determined that next print data does not exist by setting the flag in the final determination flag area at step S13.

By this arrangement, in a case where it is determined at step S12 through step S13 that the printing based on the received print data has been completed and the process proceeds to step S7, even if unprinted print data exists in the received print data, the print operation thereafter is not performed.

In this manner, according to the present invention, as the apparatus for detecting an end portion of the continuous paper 2 is realized by comprising: the mechanism that guide-conveys the roll of continuous paper 2 accommodated in the hopper 3 along the guide passage P; the means for performing a print operation with a predetermined maximum print size on the continuous paper 2 by drive-controlling the print unit 4 and the cutter unit 35; the mechanism that supports the pair of supported members 12, having the flanges 13 removably attached to centers of both ends of the continuous paper 2 and opposed to both end surfaces of the continuous paper 2, rotatably and removably in the hopper 3; the plural detection marks (holes 14) provided in the flange 13 around the axis of the continuous paper 2; the rotation detection sensor 15 that outputs an output value which varies in correspondence with the presence/absence of the detection mark (hole 14) in the detection position; the means for determining the presence/absence of the detection mark (hole 14) based on the output value from the rotation detection sensor 15; and the means for determining a rear end of the continuous paper 2 in the hopper 3 if the result of determination of the presence/absence of the detection mark (hole 14) during conveyance of the continuous paper 2 does not change. And in the apparatus for detecting an end portion of the continuous paper 2, the passage length PL from the rear end position 21 of the continuous paper 2 in the hopper 3 to the print unit 3 is equal to or longer than the maximum print size. In the printer 1 having a hopper without shaft, the rear end of the continuous paper 2 can be detected without upsizing the apparatus or complicating the structure, and the continuous paper 2 can be effectively utilized without causing shortage of continuous paper during execution of print operation.

Further, according to the present embodiment, if the rear end of the continuous paper 2 in the hopper 3 is determined, the means for performing the print operation stops the print operation thereafter. Accordingly, the occurrence of shortage of continuous paper during execution of printing can be more reliably prevented.

Further, according to the present embodiment, the detection mark is the hole 14 formed in the flange. Accordingly, the means for determining the presence/absence of the detection mark can determine the presence/absence of the detection mark 14 based on the output value from the rotation detection sensor 15 in a case where the outer diameter of the continuous paper 2 is smaller than the detection position by the rotation detection sensor 15, and the detection of the rear end of the continuous paper 2 can be more accurately determined during execution of print operation.

Further, according to the present embodiment, the means for determining the rear end of the continuous paper 2 in the hopper 3 determines the rear end of the continuous paper in the hopper after it is detected that the result of determination of the presence/absence of the detection mark 14 during the conveyance of the continuous paper 2 is different. Accordingly, the detection of the rear end of the continuous paper 2 can be accurately determined during execution of print operation.

Further, according to the present embodiment, the detection marks 14 are provided so as to pass the detection position during the conveyance of the continuous paper 2 by the minimum print length L determined in correspondence with a minimum print unit of the print unit 4. Accordingly, the rear end of the continuous paper 2 in the hopper 3 can be more accurately detected.

Apparently, many corrections and changes can be made in accordance with the above description. Accordingly, it is understood that the present invention can be embodied in other aspect than that concretely described here within the scope of attached claims.

What is claimed is:

1. An apparatus for detecting an end portion of a recording medium, said apparatus comprising:

a mechanism that guide-conveys continuous paper, which is accommodated in a roll in a hopper, along a guide passage;

means for performing a print operation with a predetermined maximum print size on said continuous paper by drive-controlling a print unit and a cutter unit;

a pair of supported members which are rotatably and removably supported in said hopper, and each of which comprises a flange, said flanges being removably attached to centers of both ends of said roll of continuous paper so as to be opposed to both end surfaces of said roll of continuous paper;

a plurality of detection marks provided in at least one said flange around an axis of said roll of continuous paper;

an optical sensor that outputs an output value which varies in correspondence with whether or not one of said detection marks is present in a detection position of said optical sensor during conveyance of said continuous paper;

first determining means for determining whether one of said detection marks is present in the detection position based on the output value from said optical sensor; and second determining means for determining that a rear end of said continuous paper in said hopper has been reached if a result of the determination of whether said one of said detection marks is present in the detection position does not vary during conveyance of said continuous paper;

wherein a passage length from the rear end position of said continuous paper in said hopper to said print unit is at least as long as said maximum print size.

2. The apparatus according to claim 1, wherein when said second determining means determines that the rear end of said continuous paper in said hopper has been reached, said means for performing said print operation stops the print operation for a subsequent print operation.

3. The apparatus according to claim 1, wherein each said detection mark comprises a hole formed in said flange.

4. The apparatus according to claim 3, wherein said first determining means performs the determination of whether said one of said detection marks is present in the detection position based on the output value from said optical sensor after it is determined that an outer diameter of said roll of continuous paper is closer to the axis of said roll than the detection position of said optical sensor.

5. The apparatus according to claim 1, wherein said detection marks are arranged such that at least one of said marks passes said detection position during the conveyance of said continuous paper by a minimum print length corresponding to a minimum print unit of said print unit.

6. The apparatus according to claim 4, further comprising third determining means for determining that the outer diameter of said roll is closer to the axis of said roll than the detection position of said optical sensor when the output value of said optical sensor varies by more than a predetermined amount during the conveyance of said continuous paper.

* * * * *